US005653171A

United States Patent [19]

LeBron et al.

[11] Patent Number: 5,653,171

[45] Date of Patent: Aug. 5, 1997

[54] TUMBLEABLE CAPSULE STRUCTURE FOR DOWNWARD-RAMP RACES

[76] Inventors: Richard C. LeBron; Shelden P. LeBron; Dickson B. LeBron, all of 6114 Country Club Rd., Omaha, Nebr. 68152

[21] Appl. No.: 675,860

[22] Filed: Jul. 5, 1996

[51] Int. Cl.[6] ..... A63G 29/00

[52] U.S. Cl. ..... 104/60; 104/53; 104/68; 446/168; 446/324

[58] Field of Search ..... 104/53, 60, 78, 104/68, 77; 446/168, 324, 437, 444; 472/50; 273/86 C

[56] References Cited

U.S. PATENT DOCUMENTS

| | | | |
|---|---|---|---|
| 622,354 | 4/1899 | Harvey | 446/324 |
| 995,945 | 6/1911 | Berhold | 104/78 |
| 1,383,316 | 7/1921 | Liebert | 446/168 |
| 1,614,471 | 1/1927 | Hayashi . | |
| 2,585,780 | 2/1952 | Johnson | 446/324 |
| 2,859,968 | 11/1958 | Modica, Jr. . | |
| 3,519,273 | 7/1970 | Viby . | |

FOREIGN PATENT DOCUMENTS

| | | |
|---|---|---|
| 18059 | 5/1912 | United Kingdom . |

*Primary Examiner*—S. Joseph Morano
*Attorney, Agent, or Firm*—George R. Nimmer

[57] ABSTRACT

Disclosed are improved, unpredictably tumbleable capsule structures that are loosely internally provided with weighty rollable spherical ball, whereby such improved capsule is adapted to unpredictably compete with identical tumbleable capsule structures along downwardly-inclined ramps. Such improved tumbleable capsule structures are preferably circularly symmetrical about a directionally longitudinally extending horizontal central-axis and also about a central vertical-plane, and having uniquely ratioed capsule housing and interior rollable sphere interdimensional parameter values. Ancillarily disclosed are improved topically-textured and judicially-inclined racing ramps and ramp starting gates, all devoted toward enhancing unpredictable racing capability for a plurality of identically constructed internally-weighted tumbleable capsule structures along downwardly-extending ramps.

6 Claims, 2 Drawing Sheets

FIG. 3A: OD/L ≅ 0.50 - 0.75
FIG. 3B: RD/OD ≅ 1.05 - 1.50
FIG. 3C: OD > ID (BY A SMALL AMOUNT)
FIG. 3D: BD/ID ≅ 0.55 - 0.99

TUMBLEABLE CAPSULE STRUCTURE FOR DOWNWARD-RAMP RACES

BACKGROUND OF THE INVENTION

As exemplified by teachings of U.S. Pat. No. 1,614,471 (Hayashi—Jan. 13, 1927); U.S. Pat. No. 2,859,968 (Modica—Nov. 11, 1958); and U.S. Pat. No. 3,159,273 (Viby—Jul. 7, 1970): the prior art teaches some unpredictably tumbleable capsule structures intended to raceably compete with identical capsule structures along a selectable downwardly-inclined ramp means. However, such prior art capsule structures are structurally deficient in that they do not provide, even among several identically structurally constructed capsules, non-predictive competitive racing success along the same downwardly-inclined ramp means.

OBJECTS OF THE INVENTION

In view of the foregoing Background discussion, it is the general objective of the present invention to provide improved tumbleable capsule structures adapted to tumbleably end-over-end downwardly raceably compete, but with non-predictive success, with identically constructed tumbleable capsule structures, along selectable downwardly-inclined ramps. Related objectives include, include inter alia, improved downwardly-inclined ramps that are aptly topically-textured, laned, and/or having inter-capsules starting-gates and finish-line visibility, all toward enhancement of ramp racing capability and interest among a plurality of identical end-over-end tumbleable capsule structures.

GENERAL STATEMENT OF THE INVENTION

With the above general objectives in view, and together with ancillary and specific objectives in view, which will become more apparent as this description proceeds, the improved and uniquely tumbleable capsule concept of the present invention generally comprises: a thin-walled housing member including central-zones bi-directionally flanking a vertical-plane and symmetrical about a perpendicular central axis; and endwardly provided with similarly thin-walled end-caps; circularly surrounding said central-zones a uniquely constructed shoulder member; and a weighty spherical ball rollably disposed within said central zones and end-caps housing and together with unique dimensional inter-relational parameters among said thin-walled housing member and the said internally rollable weighty spherical ball.

BRIEF DESCRIPTION OF THE DRAWING

In the drawing, wherein like characters refer to like parts in the several views, and in which:

FIGS. 3A, 3B, 3C, and 3D, depict arithmetic ratio parameter values for the tumbleable capsule structure representative embodiment 9 disclosed in said FIGS. 1, 2 and 3;

DETAILED DESCRIPTION OF THE DRAWING

Figure 1:
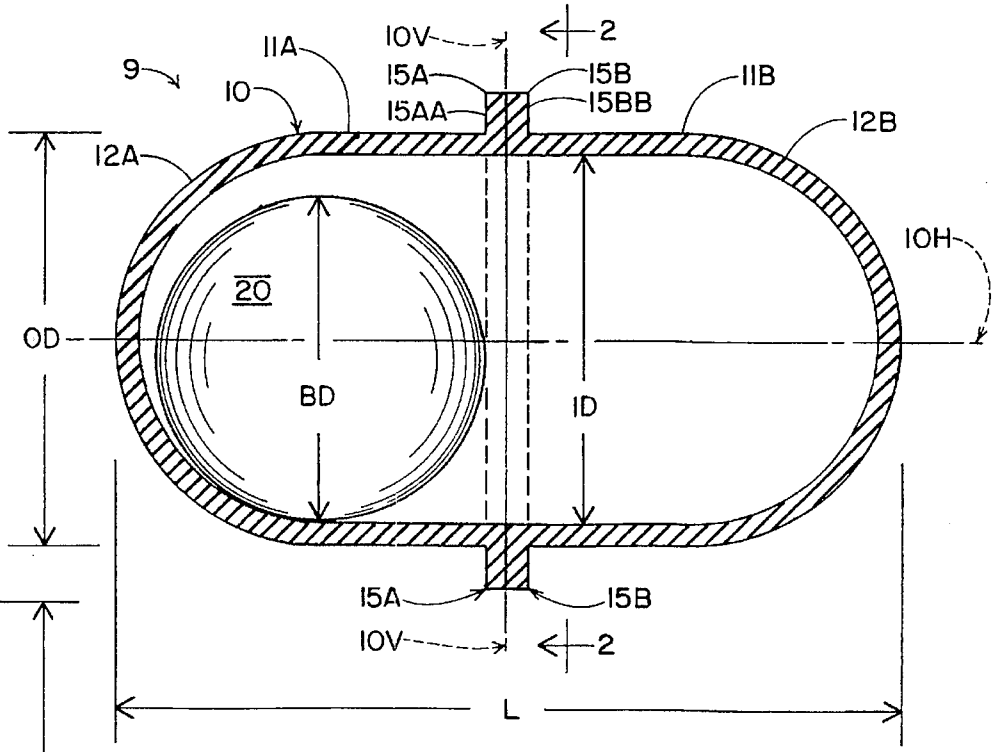
FIG. 1 is a directionally longitudinally extending sectional elevational view of a representative tumbleable capsule structure embodiment 9 taken along line 1—1 of the FIG. 3 side elevational view for such representative embodiment 9.
Figure 3:
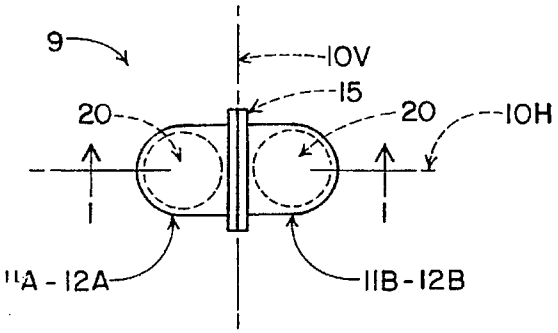
FIG. 3 is a side elevational view of representative embodiment 9 of the tumbleable capsule structure invention of the present invention.
Figure 2:
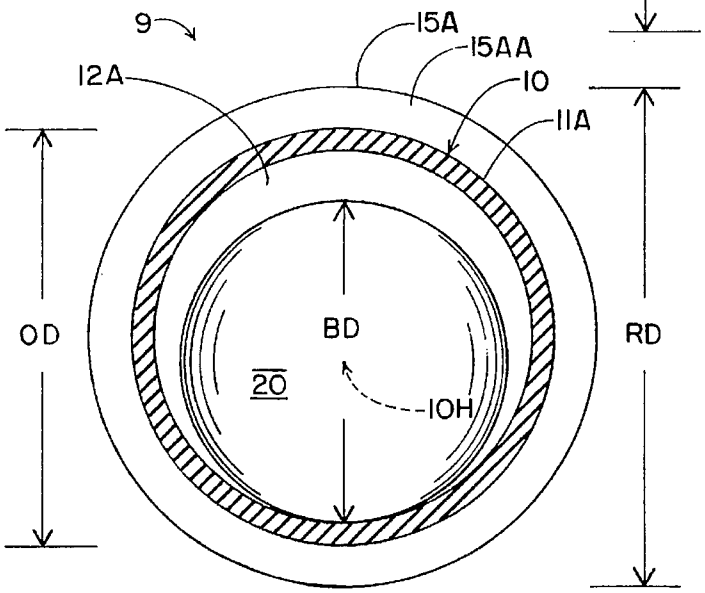
FIG. 2 is a sectional elevational view taken along lines 2—2 of FIG. 1.

With especial initial reference to drawing FIGS. 1–3D, representative embodiment 9 of the aptly tumbleable capsule structure concept of the present invention, which is unpredictably downwardly competitively raceable along apt ramp means (e.g. 99) with identical tumbleable capsule structures, generally comprises: a thin-walled housing (10) that is generally symmetrical about a directionally longitudinal horizontal central-axis (10H) and that is also bi-directionally-longitudinally symmetrical about a central vertical-plane (10V) that centrally perpendicularly intersects such central-axis (10H): and together with appropriately dimensionally parametrically inter-relationships for such housing (10) and with a rollable spherical ball (20) therewithin. The thin-walled housing portion comprises:

(A1): thin-walled (i.e. outside-diameter OD minus inside diameter ID) central-zone 11 preferably extending circularly concentrically about such horizontal central-axis 10H at similar inside-radii value (½ ID), and which directionally longitudinally extending distinct central-zone-lengths (11A, 11B) extend similarly directionally longitudinally from vertical-plane 10V;

(A2) said uniformly thin-walled and directionally longitudinally extending central-zone-lengths (11A, 11B) being respectively endwardly equipped with similarly thin-walled hemispherical end-caps (12A, 12B) respectively converging toward horizontal central-axis 10H, whereby said housing portion (10) has a directionally longitudinally extending horizontal-length (L) along central-axis 10H that bears a ratio within the range of substantially 1 ⅓ to 2, as compared to said mathematically similar inside-diameter(ID) and outside-diameter (OD) values. The mathematical reciprocal of this 1 ⅓ to 2 range is 0.50 to 0.75 (FIG. 3A) and (A3) circularly outwardly surrounding the said horizontal central-axis (10H) and also beyond said thin-walled housing central-zone (11, 11A, 11B) at vertical-plane (10V), there is an external shoulder (15) for such tumbleable capsule (e.g. 9) and which external shoulder (15) has an external shoulder-diameter RD, circularly concentric about central-axis 10H, and that bears a ratio within the range of 1.05 to 1.50, as compared to said mathemetically-similar housing inside-diameter (ID) and outside-diameter(OD). For reasons to be explained later and with concern toward a selectable ramp means (99), the external shoulder (15) at said circularly surrounding shoulder-diameter RD is sharply-cornered (e.g. 15A, 15B); in this general vein for sharp-corners, opposed sides of shoulder member 15 (e.g. sidewalls 15AA, 15BB) might be co-planar and respectively perpendicular to horizontal central-axis 10H.

And with further regard to the above-described housing structure embodiment (9) and dimensional parameter values therefor: such central-zone portion (11A) and end-cap therefor (12A) might be together constructed of the same structural material (e.g. metallic, but preferably resinous); and another such central-zone portion (11B) and end-cap (12B) therefore might be together similarly singularly constructed of the same structural material (e.g. metallic, but preferably resinous); and which portions 11A–12A and 11B–12B being joined together along housing central vertical plane 10V (e.g. with welding, resinous adhesive, etc.).

And yet with further regard to such housing structure (10), the preferably metallic, weighty spherical ball portion (20) of the representative capsule structure embodiment (9) has a ball diameter (BD) that bears a ratio within the range of 0.55 to 0.99 as compared to said housing in-side-diameter value (ID), whereby such spherical ball (20) has the capability of freely rolling along housing central-axis 10H bi-directionally, and within each such reciprocatable traveling longitudinal-path (10H) is abuttable against an end-cap terminus so as to cause downward-ramp (e.g. 99) unpredicatable racing competition among a plurality of identical such tumbleable capsule structure (e.g. 9), as will be explained here below.

Figure 4:
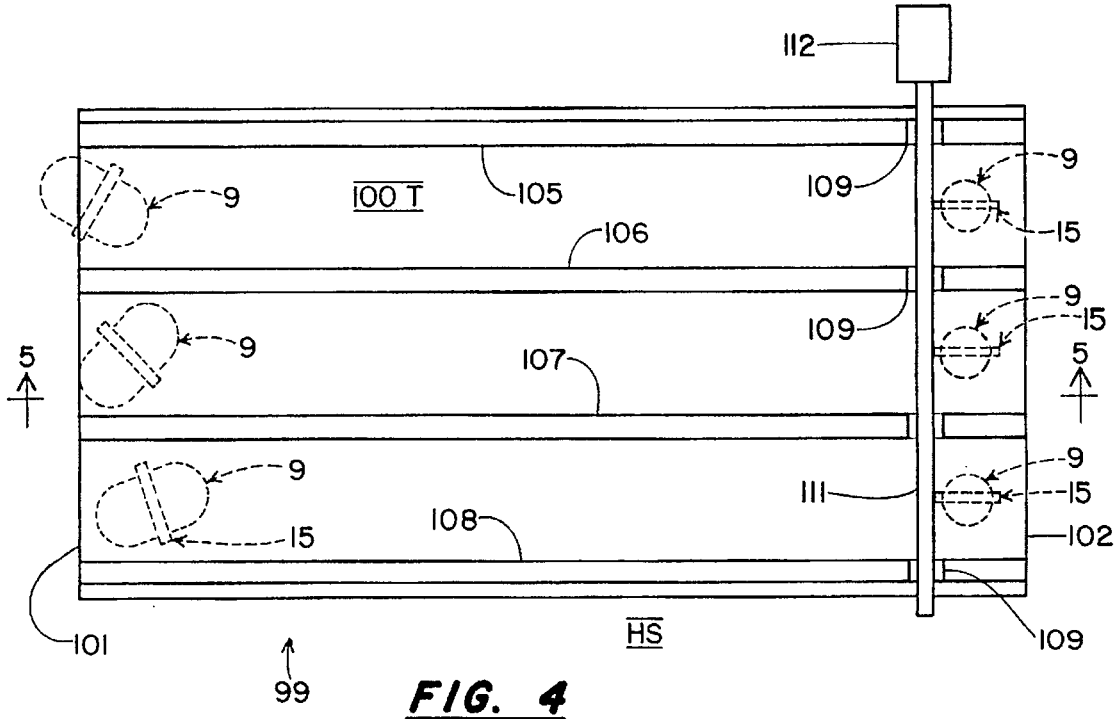
FIG. 4 is a top plan view of a representative downward-ramp enhancing unpredictable downward-racing capability for a plurality of such identical tumbleable capsule structures (e.g. 9) downwardly along a such downward-ramp (99) of FIGS. 4 and 5.
Figure 5:
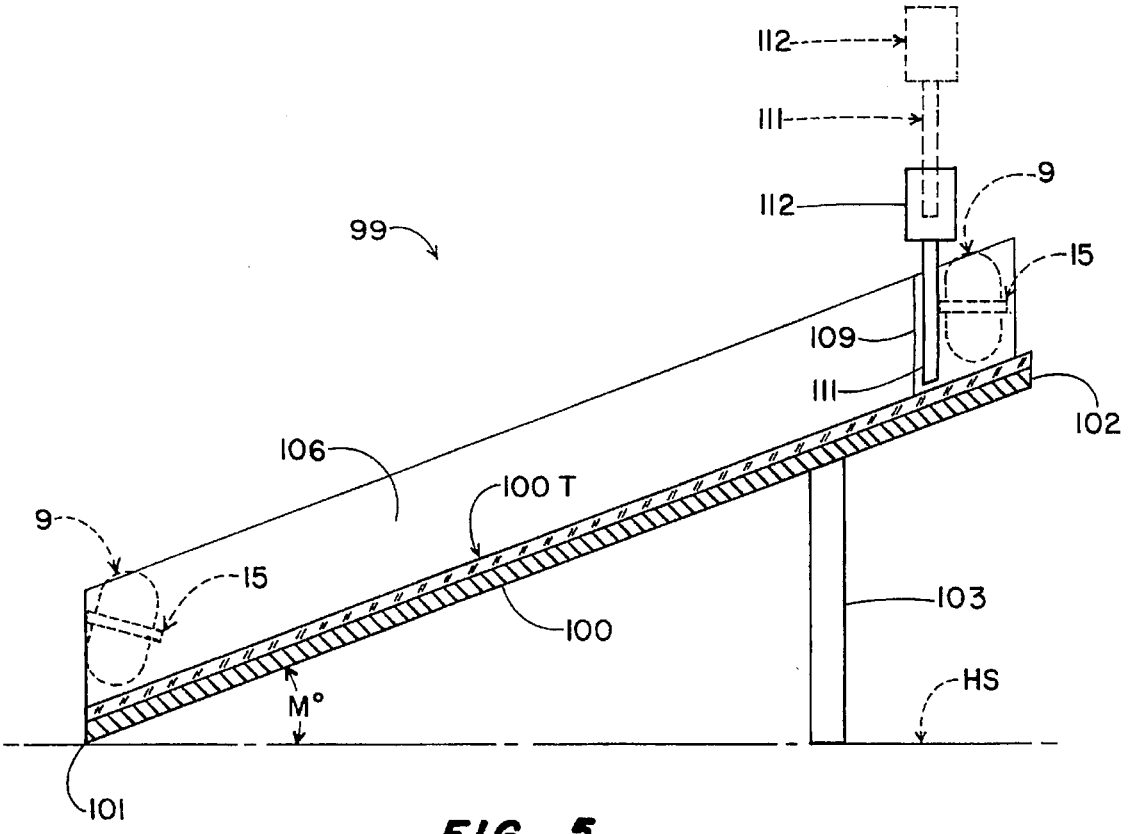
FIG. 5 is a sectional elevational view of the representative downward-ramp embodiment (99) taken along line 5—5 of FIG. 4.

Drawing FIGS. 4 and 5, aforementioned, refer to a representative, though non-limiting, downwardly-inclined ramp structure (e.g. 99) for affording unpredictable downward racing capability among a plurality of the tumbleable capsule concept of the present invention. A rudimentary, but non-limiting ramp embodiment 99, comprises an inclined-plate 100 maintained at an M° inclination value (within the M° range of 5° to 25° and preferably substantially 12°), the plate fore-end 101 being functionable as a race "finish-line" and permissably restable upon a horizontal substrate "HS", and with the inclined-plate aft-end 102 being raised above substrate "HS", as by a rearwardly located upright-prop 103. The ramp inclined-plate 100 is preferably topically provided with a non-slick high-friction topical-layer 100T (e.g. of rubber, textile cloth, non-woven cloth, etc. ) adapted to strategically frictionally-interact at the capsule's shap sharp-corners (15A, 15B) to impart unpredicatable and predominately downward racing capability among identically structured tumble-able capsules (e.g. 9).

Desireably, though not necessarily, a such ramp (e.g. 99) can be provided with upwardly-extending parallel ramp-walls (e.g. 105, 107, 108) to lanes-wise separate downwardly tumbleably raceable capsules (e.g. 9); and a rearwardly positioned racing starting-gate (eg 110) for simultaneously downwardly launching a plurality of individually-laned downwardly unpredictably competitively raceable identical tumble-able capsules. In the latter regard: each such ramp-walls (105–108), immediately downwardly of plate aft-end 102, with together be provided with directionally transversely-aligned and upwardly-extending slots 109 so as to slidably accommodate therewithin a barrier-plate portion 111 of a said rudimentary starting-gate 110. Such barrier-plate, directionally transversely beyond ramp-plate 100 might be provided with a liftable handle 112. Thus, as indicated in FIG. 5 phantom lines: upon upward initiation of liftable handle 112, the co-movable barrier-plate 111 becomes upwardly removed from wall-slots 109 to permit the tumbleably identical capsules (9) to gravitationally-downwardly unpredictably race toward the ramp means "finish-line" (e.g. plate fore-end 101).

In view of the foregoing, the construction and raceable operation of the tumbleable capsule structure concept of the present invention will be readily understood and further explanation is believed to be unnecessary. However, since numerous embodiments and equivalents of the tumvleable capsule concept of the present invention will be readily understood by those skilled in the art, it is not desired to limit the invention to the exact constructions shown and described, and accordingly, all legally equivalents are intended to be claimed by the inventors within the context of the appended claims.

We claim:

1. Tumbleable Capsule Structure adapted to unpredictably compete with identical tumbleable capsule structures downwardly along a selectable ramp, and each said tumbleable capsule structure extending generally similarly circularly about a directionally longitudinally extending horizontal central-axis and also bi-directionally longitudinally from a capsule vertical-plane that perpendicularly intersects said horizontal central-axis, and said tumbleable capsule structure comprising:

(A) a uniformly thin-walled housing member comprising:
- (A1) similarly thin-walled and longitudinally bi-directional central-zones flanking said vertical-plane at an inside-diameter value from said horizontal central-axis at said vertical-plane;
- (A2) each said uniformly thin-walled central-zone, longitudinally remote from said vertical-plane, being provided with similarly thin-walled end-caps respectively endwardly converging toward said horizontal central-axis, whereby said housing member has a longitudinal-length central-axis value that bears a ratio within the range of substantially 1⅓ to 2 as compared to said inside-diameter value; and
- (A3) a shoulder member circularly concentrically surrounding said central-axis outwardly beyond the thin-walled housing central-zone along the vertical-plane thereof, and having an outward shoulder-diameter that bears a ratio within the range of substantially 1.05 to 1.50 as compared to said housing inside-diameter value; and (B) a weighty spherical ball that is freely rollably disposed within said housing and having a ball-diameter value representing a ratio within the range of substantially 0.55 to 0.99 as compared to said housing inside-diameter value, and said spherical ball having the capability of rolling longitudinally bi-directionally along said central-axis and thereby abuttably at said housing end-caps.

2. The structure of claim 1 wherein each said housing central zone regularly circularly surrounds said horizontal longitudinal central axis by identical one-halfs of said inside-diameter value.

3. The structure of claim 2 wherein said housing, flanking said central vertical-plane, comprises two identical separately-joined parts, and each part comprising: a said central-zone length endwise attached to a hemispherical said end-cap, and a portion of said housing shoulder member.

4. The structure of claim 3 wherein the shoulder-diameter regularly circularly surrounds said horizontal central-axis to thereby intersect shoulder member upright-sides at sharply-defined corners to enhance the downward-ramp raceably competitive interest among a plurality of such unpredictably raceably competing tumbleable capsule structures.

5. The structure of claim 1 wherein the housing shoulder member, on opposite sides of said central vertical-plane, has upright-sides co-parallel with each other and thus perpendicular to said horizontal central-axis.

6. The tumbleable capsule structure of claim 1 wherein the housing shoulder member at the shoulder-diameter thereof, and on both sides of said housing central vertical-plane, has sharply-angled corners adapted to provide unpredictable and predominately-downward racing capability along a topically-textured downwardly-inclined ramp structure.

* * * * *